US009902161B2

(12) United States Patent
Arimura

(10) Patent No.: US 9,902,161 B2
(45) Date of Patent: Feb. 27, 2018

(54) INK CARTRIDGE

(71) Applicant: RISO KAGAKU CORPORATION, Tokyo (JP)

(72) Inventor: Eijiro Arimura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/413,865

(22) Filed: Jan. 24, 2017

(65) Prior Publication Data

US 2017/0217195 A1 Aug. 3, 2017

(30) Foreign Application Priority Data

Jan. 29, 2016 (JP) ..... 2016-016073

(51) Int. Cl.
*B41J 2/175* (2006.01)

(52) U.S. Cl.
CPC ..... *B41J 2/17523* (2013.01); *B41J 2/1752* (2013.01); *B41J 2/17513* (2013.01)

(58) Field of Classification Search
CPC ..... B41J 2/17523
USPC ..... 347/86
See application file for complete search history.

(56) References Cited

U.S. PATENT DOCUMENTS

2003/0001934 A1* 1/2003 Kitabatake ..... B41J 2/17503 347/86
2009/0002431 A1 1/2009 Osawa et al.
2009/0141106 A1 6/2009 Takagi

FOREIGN PATENT DOCUMENTS

| | | |
|---|---|---|
| EP | 1 380 428 | 1/2004 |
| JP | 11-65253 | 3/1999 |
| JP | 2010-82994 | 4/2010 |
| JP | 2014-213565 | 11/2014 |

OTHER PUBLICATIONS

Extended European Search Report for EP 17153621.2 dated Jun. 19, 2017.

* cited by examiner

*Primary Examiner* — Huan Tran
*Assistant Examiner* — Alexander D Shenderov
(74) *Attorney, Agent, or Firm* — Greenblum & Bernstein, P.L.C.

(57) ABSTRACT

An ink cartridge includes: an ink container formed of a thermoplastic film material filled with predetermined ink; an outer package as an outer box in which the ink container is inserted; and an engagement part provided at one longitudinal end part of the ink container and engaging with a cartridge attaching mechanism of a printer. Inside an ink supply section provided at a longitudinal one end of the ink container, an inner plug is provided which closes or opens an opening of a supply opening, and a covering member protecting a shaft part of the inner plug is provided while constantly covering the shaft part regardless of sliding upon attachment and detachment of an ink cartridge.

3 Claims, 6 Drawing Sheets

INK CARTRIDGE

TECHNICAL FIELD

The present invention relates to an ink cartridge attached to and detached from an ink jet printer that discharges ink to a printed medium to print an image.

BACKGROUND OF ART

Conventionally used for an inkjet printer that prints a desired image on paper serving as a printed medium has been an ink cartridge for an inkjet recorder (hereinafter simply referred to as an "ink cartridge") that stores an ink container having an ink derivation section and an ink storage section for ink supply to an ink head.

There have been demands on such an ink cartridge for achieving easier performance of attachment to and detachment from the inkjet printer, having tolerance to, for example, fall during transport and handling processes and vibration upon transport, and achieving fabrication at low costs. Thus, to meet the demands described above, the applicants of the present invention have provided an ink cartridge as disclosed in Patent Literature 1 below.

As illustrated in FIG. 6A, a conventional ink cartridge 200 is a long and thin casing of a rectangular parallelepiped shape attached to and detached from a printer in a horizontal direction (in a direction of attachment and detachment operation). The ink cartridge 200 includes: a liquid storage container 210 formed of a thermoplastic film material filled with ink; an engagement surface 220 of resin or metal which is provided at one longitudinal end of the liquid storage container and which is engaged with a cartridge attaching mechanism of the printer; and an outer package 230 of a paper (a cardboard) as an outer box in which the liquid storage container 210 is inserted.

As illustrated in FIG. 6B, arranged at a substantial center of the engagement surface 220 is an ink supply port 240, which functions as an attachment and detachment mechanism fitted in a holder part 310 of a cartridge attaching mechanism 300 on a printer side. The fitting of the ink supply port 240 in the holder part 310 connects the ink cartridge 200 and the printer to each other, so that the ink is supplied from the ink cartridge 200 to the printer.

The ink supply port 240 is provided with a joint part 241 that is fitted in the holder part 310. The joint part 241 has a hollow-shaped inside, in which an inner plug 242 for sealing the ink supply port 240 is biased by a biasing force of a biasing unit in an ink outflow direction (a rightward direction in the figure and a direction equal to a direction in which the ink is loaded onto the printer). That is, it is structured such that an enlarged-diameter portion of a tip of the inner plug 242 is pushed towards an inside of an opening part of the supply port to thereby seal the ink supply port 240.

An insertion shaft 311 which pushes the inner plug 242 into the inside of the joint part 241 upon the engagement of the joint part 241 is projected from the holder part 310 with which the ink supply port 240 is engaged. Then upon loading of the ink cartridge 200 to the printer, the insertion shaft 311 pushes in the inner plug 242 to open the ink supply port 240 and achieves communication with an ink route 320 provided at the cartridge attaching mechanism 300, so that the ink in the container flows into the printer.

CITATION LIST

Patent Literatures

{Patent Literature 1} Japanese Patent Application Laid-Open No. 2010-82994

SUMMARY OF INVENTION

Technical Problem

As described above, upon the loading of the ink cartridge 200 disclosed in Patent Literature 1 on the printer, a shaft part of the inner plug 242 moves against the biasing force of the biasing unit in a removing direction opposite to a loading direction. Upon removing of the ink cartridge 200 from the printer, the shaft part of the inner plug 242 is moved by the biasing force of the biasing unit in the loading direction.

However, in the ink cartridge of Patent Literature 1, the shaft part of the inner plug 242 is provided to be exposed in the liquid storage container, as illustrated in FIG. 6B. The liquid storage container 210 is formed of a film and does not have stiffness as is possessed by a plastic case, and is thus formed to shrink by itself as a remaining amount of ink becomes smaller.

Thus, there has been a risk that, upon the shrinkage of the liquid storage container as a result of a decrease in the remaining amount of ink, the shaft part of the inner plug 242 makes contact with an inner surface of the container, causing cracking which leads to ink leakage. Particularly, upon operation of attaching and detaching the ink cartridge 200, the inner plug 242 slides, which is therefore likely to cause cracking, further increasing the risk of ink leakage.

Thus, in view of the problem described above, the present invention has been made, and it is an object of the present invention to provide an ink cartridge in which an ink container is not damaged by an inner plug even upon operation of attachment to and detachment from a printer.

Solution to Problem

To address the object described above, a first aspect of the present invention refers to an ink cartridge including: an outer package of a box-like shape; an ink container stored inside the outer package; an engagement part arranged at one end of the outer package while inserted in the outer package in which the ink container is stored, the ink cartridge being attached to and detached from a printer; a supply opening communicating an inside and an outside of the ink container with each other and engaged with the engagement part; an inner plug having a plug part provided inside the ink container and opening and closing the supply opening and a shaft part extended from the plug part; a biasing unit provided inside the ink container and biasing the inner plug in a closing direction; and a covering member regulating a sliding direction of the inner plug and protecting the entire shaft part.

A second aspect of the present invention refers to the ink cartridge according to the first aspect wherein the covering member is provided in a manner such as to cover part of the shaft part so as not to make contact with the ink container.

A third aspect operation of the present invention refers to the ink cartridge according to the first or second aspect wherein, in the inner plug sliding upon attachment and detachment of the ink cartridge to and from the printer, a portion of the shaft part exposed from the supply opening is covered by the covering member.

Advantageous Effects of Invention

With the ink cartridge according to the first aspect, the ink supply section provided in the ink container is provided with the covering member in a state in which the shaft part of the inner plug is constantly covered regardless of presence or absence of sliding upon the attachment and detachment of the ink cartridge. Therefore, for example, even upon shrinkage of the ink container as a result of a decrease in a remaining amount of ink, an end part of the shaft part and an inner surface of the ink container do not make contact with each other.

As a result, the covering member functions as a member protecting the ink container, and thus can prevent ink leakage caused by damage to the ink container that could occur in a conventional ink cartridge.

With the ink cartridge according to the second aspect, even upon gradual shrinkage of the ink container as a result of a decrease in the remaining amount of ink, the end part of the shaft part and the inner surface of the ink container do not make contact with each other, thus eliminating a risk of damage to the ink container by the inner plug. Therefore, the user can use the ink cartridge without taking any caution for handling thereof.

With the ink cartridge according to the third aspect, even upon the shrinkage of the ink container as a result of a decrease in an ink amount at time of attachment and detachment of the ink cartridge to and from the printer, the end part of the shaft part is covered with the covering member, thus eliminating a risk of damage to the ink container as a result of sliding of the inner plug. Therefore, the user can use the ink cartridge without taking any caution for handling thereof.

DESCRIPTION OF EMBODIMENTS

Figure 1A:
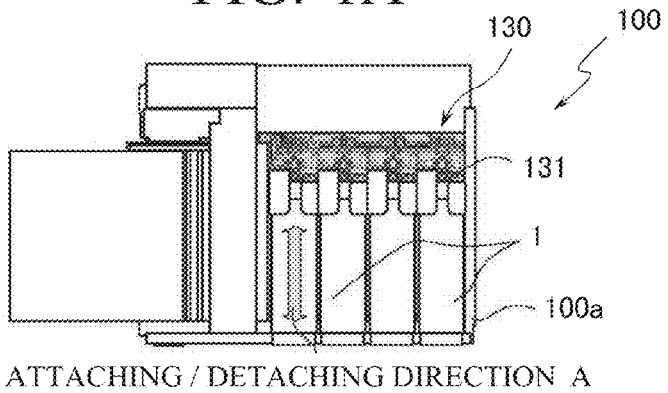
FIG. 1A is a schematic plan view illustrating configuration of an inkjet printer on which an ink cartridge according to the present invention is loaded.

An embodiment of the present invention will be described in detail with reference to the accompanying drawings. The present invention is not limited by the present embodiment, and any other possible embodiments, examples, technologies, etc. that can be carried out by those skilled in the art based on the present embodiment are all included in a scope of the present invention.

In the present specification, when terms top, bottom, right, and left are used to illustrate directions and positions in the following description provided with reference to the accompanying drawings, the aforementioned terms correspond to top, bottom, right, and left when the user views the drawings as illustrated.

A direction in which an ink cartridge 1 according to the present invention is horizontally attached to and detached from a printer 100 is defined as "attaching/detaching direction A", a direction in which the ink cartridge 1 is inserted in and loaded onto the printer 100 is defined as "loading direction A1", and a direction in which the ink cartridge 1 is removed and detached from the printer 100 is defined as "removing direction A2".

Further, the loading direction A1 is equal to a direction in which ink filled in the ink cartridge 1 flows out to the printer 100 (hereinafter referred to as "ink outflow direction B"), and a direction in which an ink container 10 is inserted when stored into an outer package 20 is equal to the removing direction A2.

{1. Overall Configuration of Printer}

As illustrated in any of FIGS. 1A to 1C, the printer 100 loaded with the ink cartridge 1 according to the present invention will be given referring to, as an example, a line color printer of an inkjet type which includes a plurality of ink heads each having a large number of nozzles formed therein and which discharges ink of different colors from the respective ink heads to perform printing on an individual line basis and then forms a plurality of images in a manner such as to superpose the images on each other on a printed medium (paper) conveyed by a conveyance belt.

In the present embodiment, four line-type ink heads are provided. The ink heads respectively discharge the inks of four colors including black (K), cyan (C), magenta (M), and yellow (y) to perform image formation. No limitations are placed on a number of ink heads and colors and types of ink.

The printer 100 includes a control section 110 for performing overall control of various parts composing the aforementioned printer to execute printing processing in accordance with a print job. The control section 110 performs printing processing performed with the ink heads described above, driving control of a conveyance mechanism, and also control related to ink supply from the ink cartridge 1.

Further, connected to the control section 110 is a setting operation section 120 including an input device composed of, for example, operation keys and a display-input panel, and through the setting operation section 120, the user's instructions and setting operation can be received.

Figure 1B:
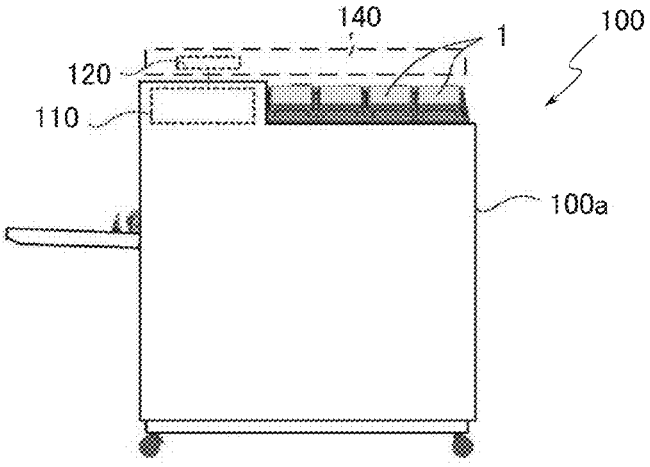
FIG. 1B is a schematic elevation view of the same printer.
Figure 1C:
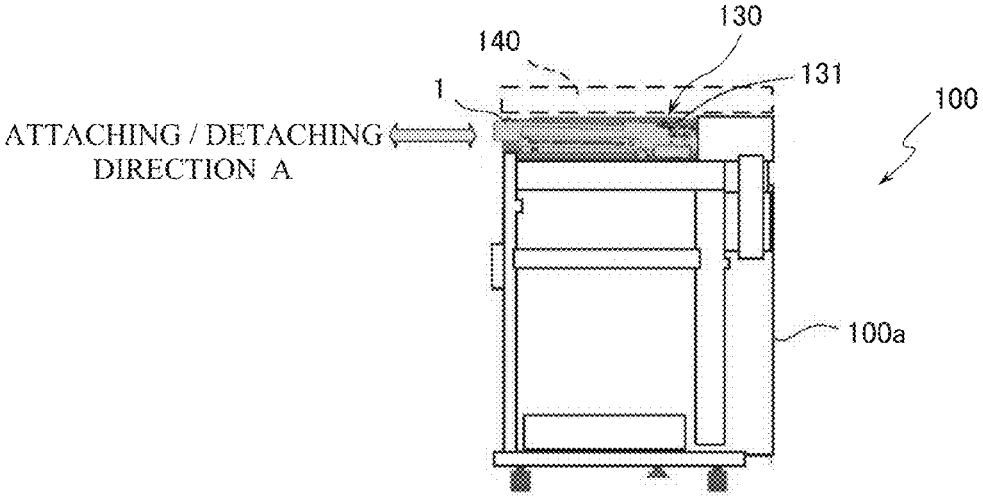
FIG. 1C is a schematic side view of the same printer.

As illustrated in FIGS. 1A and 1C, at a top part of a device body 100*a* in the printer 100, a plurality of (four in accordance with the number of ink heads in the figure) cartridge attaching mechanisms 130 to which the ink cartridge 1 is attached are provided for the respective ink heads.

A top device 140 is arranged in a manner such as to cover a top of the cartridge attaching mechanisms 130. The ink cartridges 1 are inserted horizontally (in the loading direction A1) between a bottom surface of the top device 140 and a top surface of a main body of the printer 100. For example, an image reader (scanner) that optically reads a document set in an auto document feeder (ADF) upon conveyance of the document to convert the document into digital data, and the setting operation section 120 described above are arranged at the top device 140.

Further, the cartridge attaching mechanism 130 is provided with a holder part 131 that is fitted in an engagement part 30, to be described later on, upon the loading of the ink cartridges 1 to the printer 100.

Figure 4A:
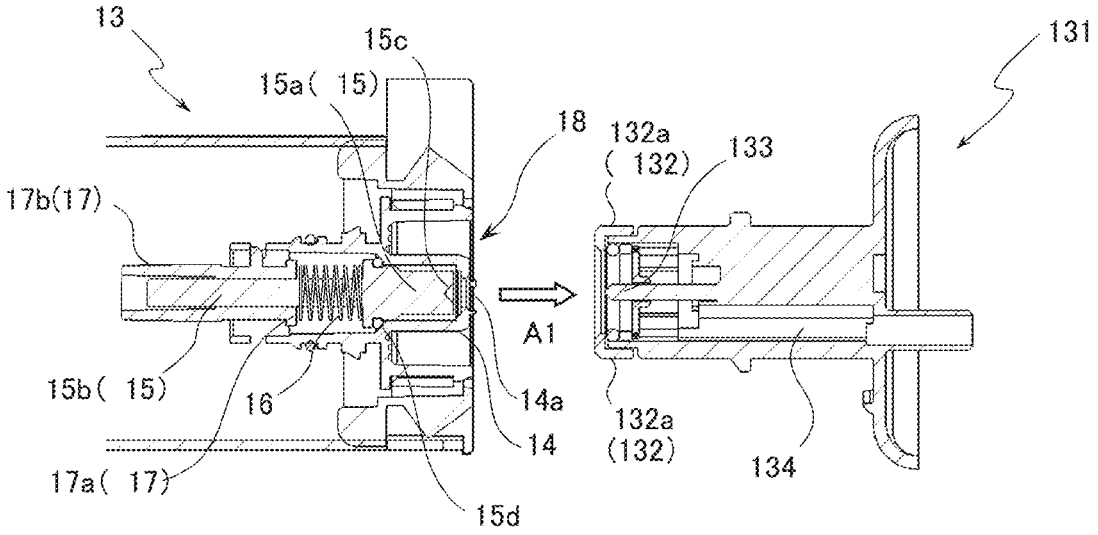
FIG. 4A is a schematic sectional view of the vicinity of the engagement part in a state before the same cartridge is loaded on the printer.
Figure 4B:
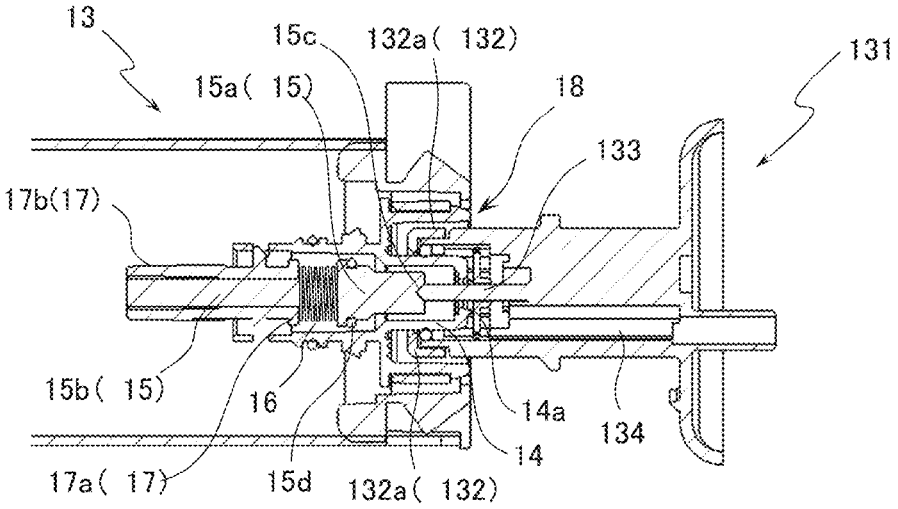
FIG. 4B is a schematic sectional view of the vicinity of the engagement part in a state in which the same cartridge is loaded on the printer.

As illustrated in FIGS. 4A and 4B, the holder part 131 includes a holder side joint part 132, to be described later on, that is fitted in a supply section side joint part 18, to be described later on, provided at an ink supply section 13, to be described later on, assembled to the engagement part 30 in a manner such as to cover the ink supply section 13. Inside the holder side joint part 132, an ink path 134 is formed that communicates with the ink supply section 13 while fitted in the supply section side joint part 18 to make ink flow into an ink tank (not illustrated) provided in the printer 100.

In the holder part 131, in the removing direction A2, a pushing part 133 is projected which is inserted into a supply opening 14 in an engaged state and inwardly pushes an inner plug 15. The pushing part 133 abuts an engagement receiving section 15*c* of the inner plug 15 and pushes in the entire inner plug 15 against a biasing force of a biasing unit 16 whereby an inside and an outside of the ink supply section 13 communicate with each other to open an ink outflow path formed with the ink path 134. As a result, the ink in the ink container 10 flows out in the ink outflow direction B.

{2. Overall Configuration of Ink Cartridge}

Next, configuration of the ink cartridge 1 according to the present invention will be described.

Figure 2A:
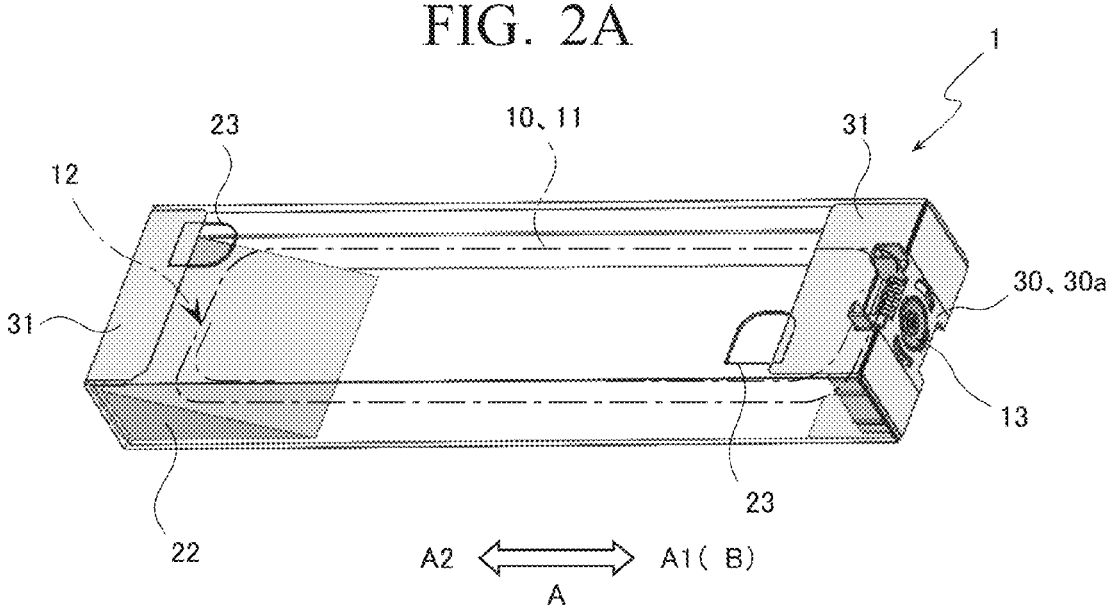
FIG. 2A is a schematic transparent view illustrating outer appearance and an inside of the same cartridge.
Figure 2B:
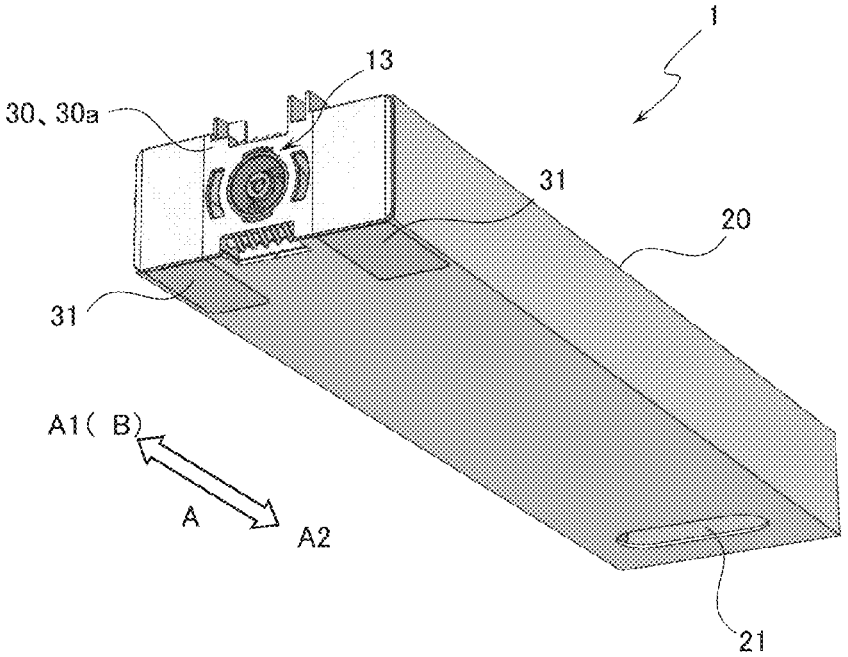
FIG. 2B is a schematic perspective view of outer appearance of the same cartridge viewed from a rear.

As illustrated in FIGS. 2A and 2B, the ink cartridge 1 is a long and thin casing of a substantially rectangular parallelepiped shape that is attached to and detached from the printer 100 in the attaching/detaching direction A as a direction horizontal to the printer 100. The ink cartridge 1 includes: the ink container 10 formed of a thermoplastic film material filled with predetermined ink; the outer package 20 serving as an outer box into which the ink container 10 is inserted; and the engagement part 30 which is provided at a longitudinal one end of the ink container 10 and which engages with the cartridge attaching mechanism 130 of the printer 100.

<2-1. Ink Container>

The ink container 10 is a bag body in which the ink is sealed. In the present embodiment, the ink container 10 is formed by superposing two thermoplastic films 11 of a rectangular shape on each other with the ink supply section 13, to be described later on, placed therebetween at the longitudinal one end and then bonding together surroundings thereof through thermal welding. The ink container 10 is inserted through an opening part of the outer package 20 and the engagement part 30 assembled with the ink supply section 13 is fitted in the opening part to thereby fabricate the ink cartridge 1.

A terminal end part 12 of the ink container 10 is formed into an acuate shape by mutually attaching a pair of surfaces parallel to a horizontal plane including the direction in which the ink container 10 is inserted into outer package 20 (the removing direction A2), that is, a top surface and a bottom surface in a state in which the ink cartridge 1 is loaded on the printer 100.

An attachment portion between the top and bottom surfaces at the terminal end part 12 is linearly formed through thermal welding, and the linear portion is located within a horizontal plane including an extension line of the ink outflow direction B and a line of the terminal end part 12 obtained by the attachment through the film thermal welding.

As described above, as a result of forming the terminal end part 12 of the ink container 10 into the acuate shape, when the remaining amount of ink in the ink container 10 has become small, the acuate shape of the terminal end part 12 can ensure inclination for outflow of the ink, which permits the ink outflow without leaving any amount of ink. Moreover, as a result of linearly forming the attachment portion at the terminal end part 12 through the thermal welding, the acuate shape of the terminal end part 12 can reliably be maintained. Further, as a result of forming the terminal end part 12 of the ink container 10 into the acuate shape and making the terminal end part 12 contact a partition member 22 set in the outer package 20 upon the insertion of the ink container 10 in the outer package 20, the ink container 10 can firmly be located inside of the outer package 20.

As illustrated in FIG. 2A, the ink supply section 13 which supplies ink filled in the container upon the loading of the ink cartridge 1 on the printer 100 is attached at an end part of the ink container 10 on a loading direction A1 side.

The ink supply section 13 is attached through thermal welding while placed at a predetermined section formed between the films 11 upon the fabrication of the ink container 10, and is so assembled as to be engaged with the engagement part 30 in the aforementioned state.

Figure 3A:
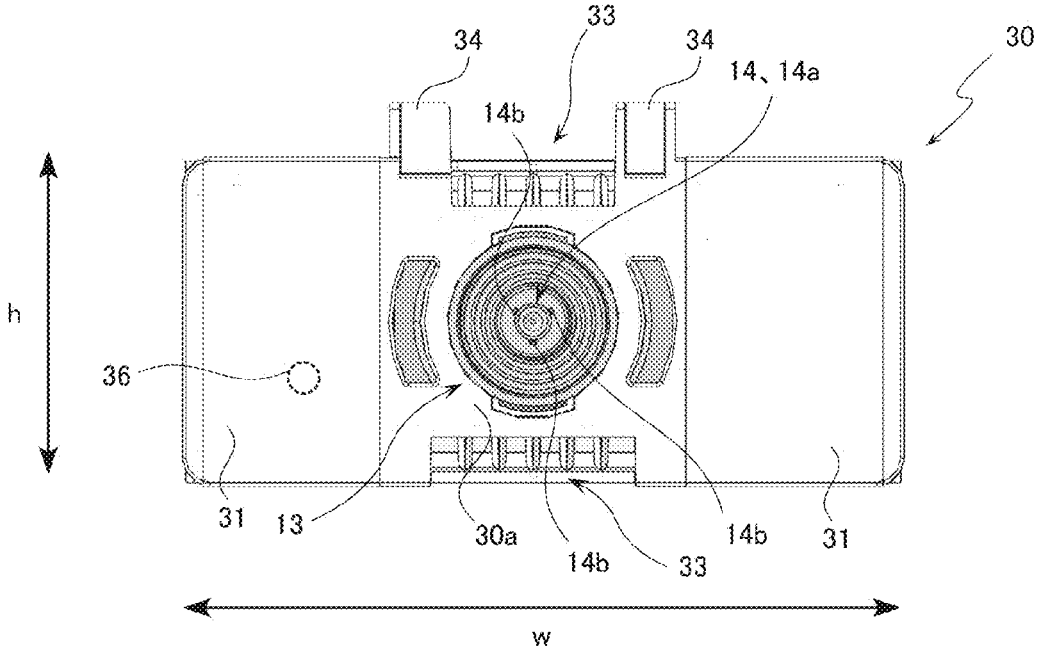
FIG. 3A is an elevation view of an engagement part of the same cartridge.
Figure 3B:
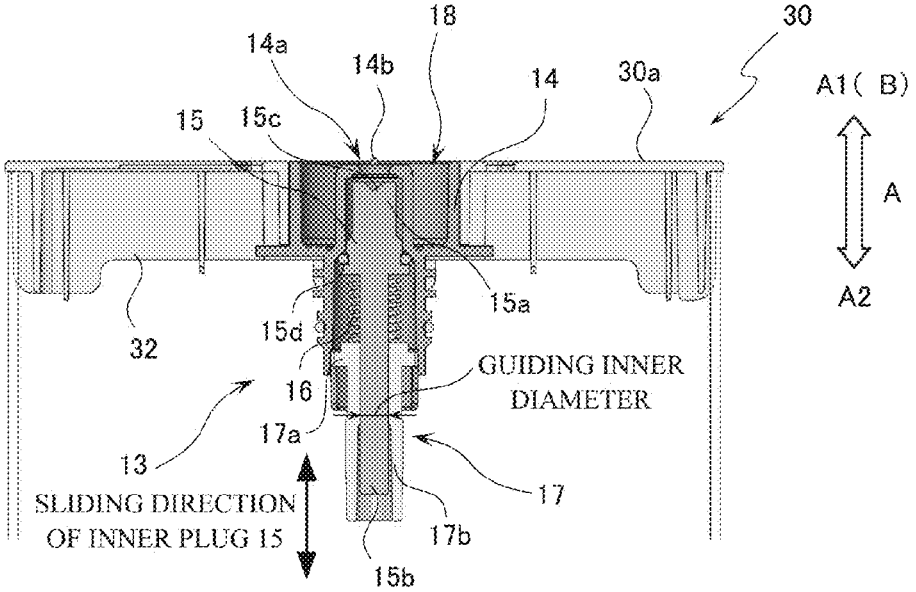
FIG. 3B is a schematic side sectional view of vicinity of the same engagement part on a partially enlarged scale.

Moreover, as illustrated in FIG. 3B on an enlarged scale, the ink supply section 13 is composed of: the supply opening 14 that communicates an inside and an outside of the ink container 10 with each other; the inner plug 15 that opens or closes the communication of the supply opening 14; the biasing unit 16 that biases the inner plug 15 in the ink outflow direction B to close the supply opening 14; and a covering member 17 that guides sliding of the inner plug 15 along the attaching/detaching direction A following attachment and detachment of the ink cartridge 1.

The supply opening 14 is located at a center of the engagement part 30 in a state in which the ink container 10 is inserted in the outer package 20. The supply opening 14 engages with the engagement part 30 with an opening 14*a* thereof directed in the loading direction A1.

In the supply opening 14, upon sliding of the inner plug 15 in an opening direction, the opening 14*a* opens, so that the inside and outside of the ink supply section 13 communicate with each other. This makes it possible for the ink in the ink container 10 to outflow in the ink outflow direction B.

At a tip of the supply opening 14, a projected part 14*b* is provided for providing a slight gap between the opening 14*a* and the holder side joint part upon the loading of the ink cartridge 1 to the printer 100 to thereby properly adjust an ink outflow amount at a fixed amount. In the present embodiment, as illustrated in FIG. 3A, three projected parts 14*b* are provided around the opening 14*a* at substantially equal intervals.

The inner plug 15 is composed of: a plug part 15*a* that has a tip abutting the opening 14*a* of the supply opening 14 to close the communication between the inside and outside of the ink container 10; a shaft part 15*b* that is extended from a rear end side (an end part located on a side opposite to a side on which an end part abuts the supply opening 14 is located) of the plug part 15*a*; the engagement receiving part 15*c* which is provided at the tip of the plug part 15*a* and which engages with the pushing part 133 of the cartridge attaching mechanism 130; and an O ring 15*d* which is fitted in surroundings of the plug part 15*a* and which fills a gap formed between the plug part 15*a* and the supply opening 14 upon the closing of the opening 14*a*.

The inner plug 15 closes the supply opening 14 with a surface on a tip side of the plug part 15*a* abutting the opening 14*a* of the supply opening 14 by the biasing force of the biasing unit 16. Moreover, the O ring 15*d* fills the gap between the plug part 15*a* and the supply opening 14 together with the plug part 15*a*. As a result, the communication between the inside and outside of the ink container 10 is blocked, so that the ink no longer outflows to the outside.

In the present embodiment, as illustrated in FIG. 4A, before the loading of the ink cartridge 1 on the printer 100, the plug part 15*a* pushes against the opening 14*a* by the biasing force of the biasing unit 16 to thereby close the opening 14*a* and also the O ring 15*d* fills the gap between the plug part 15*a* and the supply opening 14, so that the supply opening 14 turns into a closed state.

As a result of the engagement between the pushing part 133 of the cartridge attaching mechanism 130 and the plug part 15*a* upon the loading of the ink cartridge 1 on the printer 100 along the loading direction A1, the inner plug 15 slides in the removing direction A2 against the biasing force of the biasing unit 16, so that the plug part 15*a* separates from the opening 14*a*. As a result, the communication between the inside and outside of the ink container 10 is opened, making it possible for the ink to outflow to the outside along the ink outflow direction B.

In the present embodiment, as illustrated in FIG. 4B, as a result of the engagement between the engagement receiving part 15*c* provided at the tip of the plug part 15*a* and the pushing part 133 of the cartridge attaching mechanism 130 upon the loading of the ink cartridge 1 on the printer 100, the plug part 15*a* is pushed against the biasing force of the biasing unit 16 to open the supply opening 14.

The biasing unit 16 is formed of an elastic body such as a spring or a rubber, and biases the opening 14*a* of the supply opening 14 in a direction closing the opening 14*a* (that is, the loading direction A1) from a rear end side of the plug part 15*a*. In the present embodiment, a spring is used as the biasing unit 16.

The covering member 17 is composed of: a support part 17*a* that is provided at a tip of the covering member 17 to support the biasing unit 16; and a covering part 17*b* of a substantially cylindrical shape that is extended from the support part 17*a*. The covering member 17 supports the biasing unit 16 with the support part 17*a* and is also firmly provided while entirely covering a portion of the shaft part 15*b* exposed from the supply opening 14 (that is, a rear end from a substantially central portion of the shaft part 15*b* in FIG. 3B) behind the plug part 15*a*.

Since the covering part 17*b* is provided in a manner such as to entirely cover the portion of the shaft part 15*b* exposed from the supply opening 14 regardless of whether or not the inner plug 15 slides, so that, for example, even upon shrinkage of the ink container 10 as a result of a decrease in the remaining amount of ink, the end part of the shaft part 15*b* and the inner surface of the ink container 10 do not make contact with each other. As a result, there is no risk of damage to the ink container 10 by the inner plug 15, which therefore permits the user to use the ink cartridge 1 without taking any caution for handling.

As illustrated in FIG. 3B, to properly maintain sliding posture of the shaft part 15*b*, the covering part 17*b* has an inner diameter (a guiding inner diameter) that is narrowed by a predetermined distance from a substantially central portion of the plug part 15*a* to such a degree that permits sliding in the gap of the plug part 15*a*. As a result, the shaft part 15*b* slides in the proper posture along the attaching/detaching direction A upon the attachment and detachment of the ink cartridge 1.

Further, as illustrated in FIG. 3B, a portion of the covering part 17*b* from a substantially central portion thereof to a terminal end on a side opposite to the support part 17*a* is formed in a manner such as to be larger than the guiding inner diameter by a predetermined diameter.

To properly maintain the posture of the shaft part 15*b* upon the sliding thereof, a predetermined length of a portion of the guiding inner diameter needs to be formed. However, the guiding inner diameter needs to be formed in a manner such that the inner surface thereof does not make contact with the end part of the shaft part 15*b* and smoothly slides while guiding the shaft part 15*b*, which therefore requires high accuracy and raises a problem of increased manufacturing costs. Therefore, in the present invention, a portion of the covering part 17*b* where the guiding inner diameter is not required is made larger by the predetermined diameter than the guiding inner diameter, and a portion serving as the guiding inner diameter is not unnecessarily formed to thereby reduce the manufacturing costs.

Further, provided around the supply opening 14 in the ink supply section 13 is the supply section side joint part 18 of a concave shape that is fitted in the holder side joint part 132. The supply section side joint part 18 is fitted in a convex-shaped outer edge 132*a* of the holder side joint part 132 upon the loading of the ink cartridge 1 on the printer 100, as illustrated in FIG. 4B.

<2-2. Outer Package>

By bending a bending side set in a sheet member of paper (for example, a cardboard) and attaching together margins, the outer package 20 is formed into a bottomed box of a hollow rectangular parallelepiped shape with one longitudinal end open and another end thereof closed.

In the present embodiment, the opening part of the outer package 20 is formed into a rectangular shape such that a ratio between a horizontal side parallel to the horizontal plane including the attaching/detaching direction A of the ink cartridge 1 and a vertical side perpendicular to the horizontal plane is approximately 2 to 1. In other words, as illustrated in FIG. 3A, upon operation of attaching the ink cartridge 1 to the printer 100 in the loading direction A1, with the engagement part 30 on a printer 100 side being located at front, a ratio between a width w of the ink cartridge 1 and a height h thereof is approximately 2 to 1.

In the opening part (the opening part on the printer 100 side upon the cartridge loading) of the outer package 20, the engagement part 30 to be engaged with the cartridge attaching mechanism 130 on the printer 100 side is fitted, forming a surface abutting the cartridge attaching mechanism 130 of the printer 100.

Further, as illustrated in FIG. 2B, formed on a bottom surface of the outer package 20 is a concave part 21 which is to be pulled and which penetrates through a surface of the outer package 20. The concave part 21 is formed by providing a predetermined notch at a concave part forming section of the outer package 20 and bending the notched portion towards an inner surface side and a terminal end side on a member surface of the outer package 20.

At an inner terminal end of the outer package 20, the partition member 22 is arranged that ensures a form of an inner surface between the inner surface of the outer package 20 and the acuate outer surface of the terminal end part 12 of the ink container 10. The space ensured by the partition member 22 has a triangle side cross section and is also located at a position corresponding to a rear surface of the concave part 21 inside of the outer package 20.

In the present embodiment, part of the outer package 20 that is bent upon the formation of the concave part 21 is so notched as to be bent towards the terminal end side of the outer package 20 in a manner such that the aforementioned part is located in the inner space ensured by the partition member 22. For the partition member 22, for example, before closing the terminal end side, the partition member 22 may be inserted and assembled in a manner such as to be arranged at the terminal end of the outer package 20 to achieve the aforementioned closing.

As described above, providing the partition member 22 inside of the outer package 20 and the concave part 21 on the surface of the outer package 20 in the ink cartridge 1 permits the user to hold the concave part 21 at the terminal end of the outer package 20 and withdraw the ink cartridge upon operation of attaching and detaching the ink cartridge, which makes it easy to attach and detach the ink cartridge 1 and thus improves workability. Moreover, when the user holds the 21 to attach and detach the ink cartridge 1, the user's hand does not make direct contact with the ink container 10, which can prevent damage to the ink container 10 caused by contact by, for example, the user's finger or any accessory upon the cartridge attachment and detachment.

Further, the direction in which the ink container 10 is inserted into the outer package 20, the attaching/detaching direction A, and also the ink outflow direction B upon ink supply are located on the same axis, so that unnecessary stress on the outer package 20 is not generated, which can reduce possibilities that the attaching and detaching mechanism including, for example, the ink supply section 13 and the holder part 131 and the main body of the outer package 20 are damaged.

As illustrated in FIG. 2A, a notch 23 for label removal is formed at a top surface of the outer package 20 in a manner such as to be superposed on an end part of a label 31 to be described later on. The notch 23 is partially formed as a bending part and other parts thereof are broken, so that the notch 23 is formed on a surface side of the outer package 20 while connected to the outer package 20. When the notch 23 is pushed towards an inside by the finger of the user, part of the outer package 20 is broken and bent while part of the label 31 is bonded.

Therefore, the user can push the notch 23 to the inside of the outer package 20 with his or her finger and drag the label 31 and the outer package 20 away from each other while holding the broken portion to thereby achieve removal together with part of the outer package 20 at which the label 31 has been broken, which permits simple performance of classification operation.

<2-3. Engagement Part>

The engagement part 30 is formed of a hard material such as resin or metal and the abutting surface 30*a* thereof abutting the holder part 131 is directed in the loading direction A, and functions as an attaching and detaching mechanism that is engaged with the holder part 131 upon the loading of the ink cartridge 1 on the printer 100. Moreover, the engagement part 30 engages with the opening part of the outer package 20, and is thus formed in a size almost equal to a dimension of the aforementioned opening part.

As illustrated in FIGS. 2A and 2B, after being fitted in the opening part of outer package 20, the engagement part 30 is firmly attached with the seal-like label 31 having viscosity on a rear surface thereof (for example, a sheet object having an adhesive applied to a rear surface of synthetic paper primarily consisting of synthetic resin such as film technique synthetic paper). In a state in which the engagement section 30 is engaged with outer package 20, the label 31 is wound around from a side surface of the opening part of outer package 20 across a side surface of the opening part on an opposite side through the abutting surface 30*a* of the engagement section 30 whereby the engagement section 30 is firmly assembled to outer package 20.

Figure 5A:
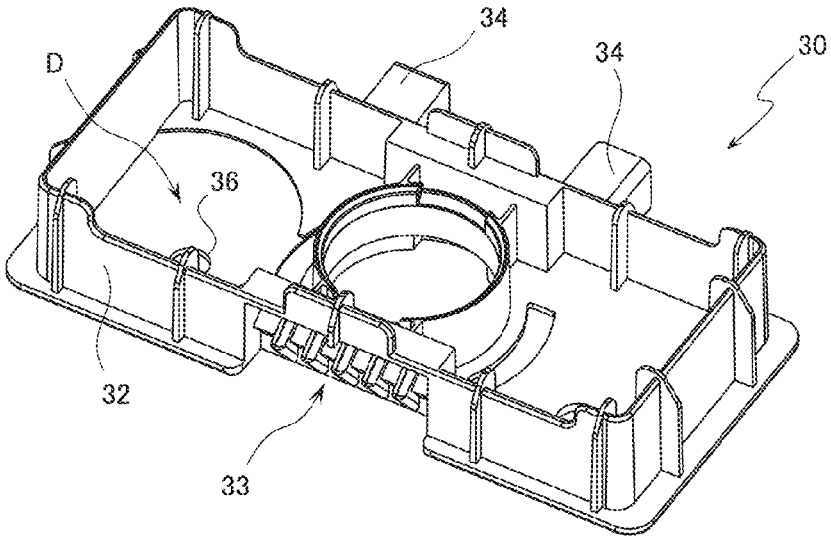
FIG. 5A is a schematic perspective view of an abutting surface serving as a surface of the engagement part viewed from a rear.
Figure 5B:
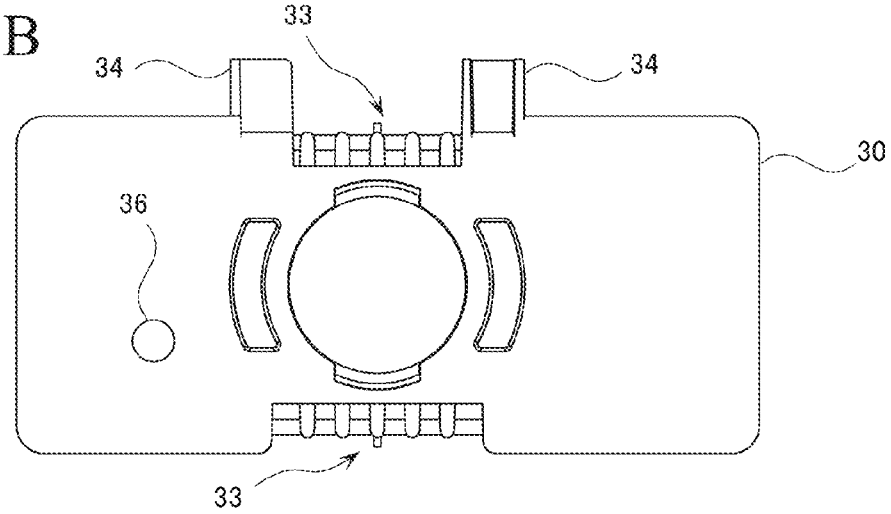
FIG. 5B is a schematic plan view of the engagement part viewed from an abutting surface side.
Figure 5C:
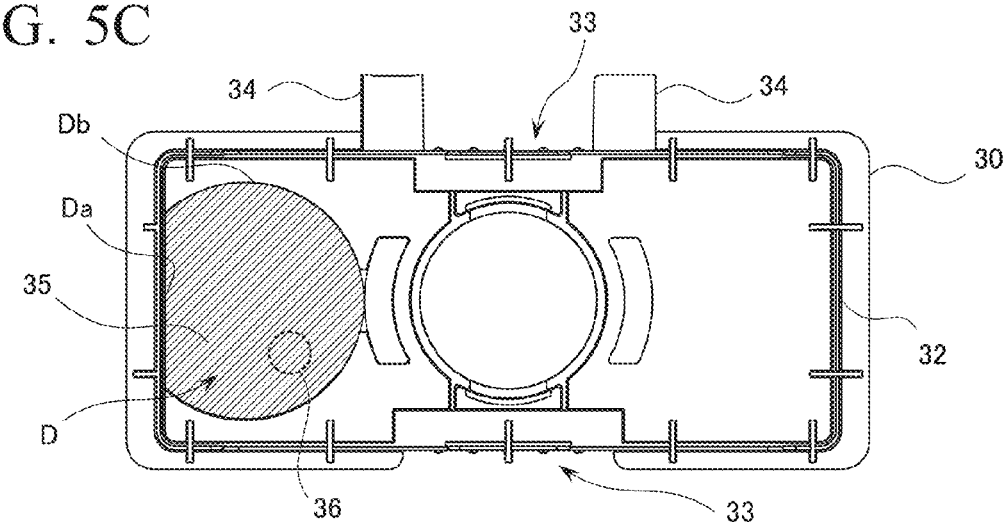
FIG. 5C is a schematic plan view of the engagement part viewed from a rear surface.
Figure 6A:
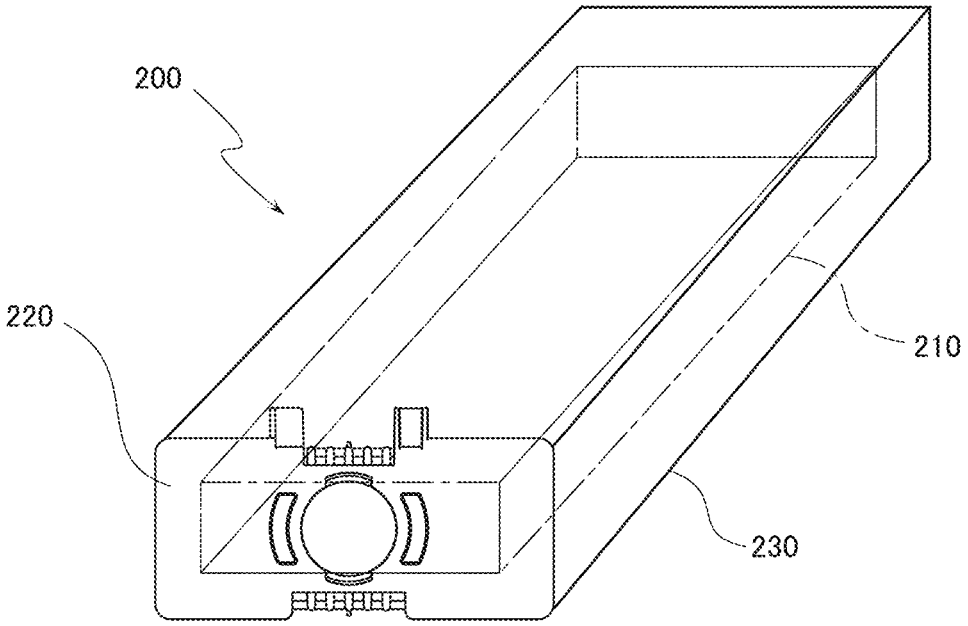
FIG. 6A is a schematic transparent view of a conventional ink cartridge.
Figure 6B:
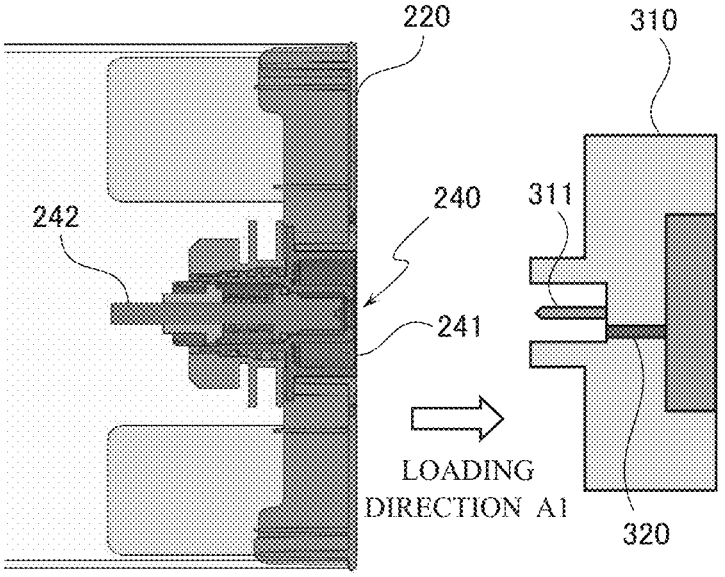
FIG. 6B is a schematic side sectional view of an engagement surface of the same cartridge on a partially enlarged scale.

As illustrated in FIGS. 5A and 5C, a fit-in rib 32 is provided upright at a circumferential edge on a rear side of the abutting surface 30*a* in the engagement part 30 abutting the holder part 131. The fit-in rib 32 is in charge of guiding upon the fit-in the opening part of the outer package 20 and preventing removal from the outer package 20 after the fit-in.

Further, as illustrated in FIG. 5B, fit-in parts 33 that are fitted in a manner such as to be held by the holder (not illustrated) provided on the printer 100 side are formed at a top and bottom of a center part of the engagement part 30. Convex parts of a triangle shape are arranged at the fit-in parts 33, and they are fitted in the holder provided at the holder part 131 of the printer 100. The holder has a mechanism of holding a pair of concave parts at the top and the bottom in a manner such as to sandwich them with an elastic force, and the convex parts of the fit-in parts 33 are pushed in between concaved parts of the holder whereby the fit-in parts 33 are fitted in with clicking feeling.

Also, a pair of blocking convex part 34 is projected from a top part of the engagement part 30. The blocking convex part 34 are provided at only one of end edges for the purpose of avoiding erroneous recognition of the top and the bottom upon the cartridge attachment. Upon the fitting in the printer 100, the blocking convex part 34 is detected by an attachment detection sensor, not illustrated, provided on the printer 100 side. More specifically, the attachment detection sensor is an optical sensor such as a flood light and receiving light sensor, and through blockage of light reception, detects presence of an object blocked. The blocking convex part 34 is approached by the attachment detection sensor upon the attachment, and blocks the light reception by the sensor whereby the attachment is detected.

Further, as illustrated in FIG. 5C, a communication tag 35 that performs short-distance wireless communication with a non-contact communication part (not illustrated) provided on the printer 100 is attached to a bonding region D formed on the rear side of the engagement part 30.

The communication tag 35 is formed of, for example, a radio frequency identification (RFID) tag, generates inner electric power by electric waves received from the non-contact communication part, and with the aforementioned electric power, performs data reading from and writing on the memory and also performs data transmission and reception through an antenna. In the present embodiment, the memory stores colors and types (water-based and oil-based) of ink of the cartridge, a number of times of attachment and detachment, etc. and upon detection of the loading on the cartridge attaching mechanism 130, starts communication with the non-contact communication section and transmits the data stored therein.

The bonding region D is formed in accordance with a shape of the communication tag 35 bonded. Specifically, the bonding region D is formed into a shape of fish sausage having: a positioning side Da abutting a chord of the communication tag 35, to be described later on, and serving to position the communication tag 35 upon the bonding thereof; and a circular arc part Db abutting a circular arc of the communication tag 35. In the present embodiment, as illustrated in FIG. 5C, the positioning side Da is formed in a manner such as to be in contact with a base end of the fit-in rib 32 provided at a left side end part of the engagement part 30. As a result, performing the bonding in a state in which the chord of the communication tag 35 is positioned with the positioning side Da permits bonding of the communication tag 35 at an appropriate position of the bonding region D.

Moreover, in the bonding region D, a tag-removing hole 36 is formed for partially removing and loading the attached communication tag 35 from a bonding surface side of the tag removal hole 36 by inserting a bar-like member from an abutting surface 30*a* side for the purpose of easily performing operation of discrimination between the engagement part 30 and the tag removal hole 36 upon disposal of the ink cartridge 1. The user can insert the bar-like member such as a driver into the tag-removing hole 36 from the abutting surface 30*a* side of the engagement part 30 to thereby easily remove part of the communication tag 35 bonded to the bonding region D and easily hold the floated portion.

As described above, with the aforementioned ink cartridge 1, the covering member 17 that protects the shaft part 15*b* of the inner plug 15 in the ink supply section 13 is so provided as to protect the shaft part 15*b* while constantly covering the shaft part 15*b* regardless of presence or absence of sliding upon the attachment and detachment of the ink cartridge 1. Thus, for example, even upon shrinkage of the ink container as a result of a decrease in the remaining amount of ink, the end part of the shaft part 15*b* and the inner surface of the ink container 10 do not make contact with each other. As a result, the covering member 17 functions as a member protecting the ink container 10, and thus can prevent ink leakage caused by damage to the ink container 10 that can occur in a conventional ink cartridge.

For the inner diameter of the covering part 17*b* of the covering member 17, the predetermined length of the guiding inner diameter portion required for maintaining the posture of the shaft part 15*b* upon the sliding thereof is provided and the other portions have an inner diameter larger than the guiding inner diameter, which therefore permits guiding in a state in which the posture of the shaft part 15*b* upon the sliding is properly maintained while reducing the manufacturing costs.

REFERENCE SIGNS LIST

1 . . . ink cartridge
10 . . . ink container
11 . . . thermoplastic film
12 . . . terminal end part
13 . . . ink supply section
14 . . . supply opening (14*a* . . . opening, 14*b* . . . projected part)
15 . . . inner plug (15*a* . . . plug part, 15*b* . . . shaft part, 15*c* . . . engagement receiving part, 15*d* . . . O ring)
16 . . . biasing unit
17 . . . covering member (17*a* . . . support part, 17*b* . . . covering part)
18 . . . supply section side joint part
20 . . . outer package
21 . . . concave part
22 . . . partition member
23 . . . notch
30 . . . engagement part (30*a* . . . abutting surface)
31 . . . label
32 . . . fit-in rib
33 . . . fit-in part
34 . . . blocking convex part
35 . . . communication tag
36 . . . tag-removing hole
100 . . . printer (100*a* . . . device body)
110 . . . control section
120 . . . setting operation section
130 . . . cartridge attaching mechanism
131 . . . holder part
132 . . . holder side joint part (132*a* . . . outer edge)
133 . . . pushing part
134 . . . ink path
140 . . . top device
A . . . attaching/detaching direction (A1 . . . loading direction, A2 . . . removing direction)
B . . . ink outflow direction
200 . . . conventional ink cartridge
210 . . . liquid storage container
220 . . . engagement surface
230 . . . outer package
240 . . . ink supply port
241 . . . joint part
242 . . . inner plug
300 . . . cartridge attaching mechanism
310 . . . holder part
311 . . . insertion shaft
320 . . . ink route

What is claimed is:

1. An ink cartridge comprising:
an outer package of a box-like shape;
an ink container stored inside the outer package; and
an engagement part arranged at one end of the outer package while inserted in the outer package in which the ink container is stored, the ink cartridge being attached to and detached from a printer;
a supply opening communicating an inside and an outside of the ink container with each other and being engaged with the engagement part;
an inner plug having a plug part provided inside the ink container and opening and closing the supply opening and a shaft part extended from the plug part;
a biasing unit provided inside of the ink container and biasing the inner plug in a closing direction; and
a covering member regulating a sliding direction of the inner plug and configured to cover at least a part of the shaft part to prevent contact with the ink container when the ink container shrinks as a result of a decrease in a remaining amount of ink in the ink container.

2. The ink cartridge according to claim 1, wherein
in the inner plug sliding upon the attachment and detachment of the ink cartridge to and from the printer, at least a part of a rear end of the shaft part exposed from the supply opening is covered by the covering member.

3. The ink cartridge according to claim 1, wherein
the covering member extends in an axial direction of the shaft part and includes a slide guiding section and a terminal end section,
the slide guide section has a slide guiding diameter that controls a sliding posture of the shaft part,
the terminal end section has a terminal end diameter that accommodates an end part of the shaft part, and the slide guiding diameter is more narrow than the terminal end diameter.

* * * * *